US009857767B2

(12) United States Patent
Asanuma et al.

(10) Patent No.: US 9,857,767 B2
(45) Date of Patent: Jan. 2, 2018

(54) PROCESS CARTRIDGE AND IMAGE FORMING APPARATUS

(71) Applicant: CANON KABUSHIKI KAISHA, Tokyo (JP)

(72) Inventors: Naoya Asanuma, Susono (JP); Go Torii, Mishima (JP); Junichi Matsumura, Numazu (JP); Masahito Kato, Gotemba (JP); Atsushi Toda, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/287,589

(22) Filed: Oct. 6, 2016

(65) Prior Publication Data

US 2017/0108828 A1 Apr. 20, 2017

(30) Foreign Application Priority Data

Oct. 14, 2015 (JP) ..... 2015-203147

(51) Int. Cl.
*G03G 21/18* (2006.01)

(52) U.S. Cl.
CPC ..... *G03G 21/1867* (2013.01); *G03G 21/1817* (2013.01); *G03G 21/1842* (2013.01)

(58) Field of Classification Search
CPC ..... G03G 21/1817; G03G 21/1825; G03G 21/1842; G03G 21/1867; G03G 21/1652; G03G 2221/166; G03G 2221/1853; G03G 2221/1861
USPC ..... 399/111, 113
See application file for complete search history.

(56) References Cited

U.S. PATENT DOCUMENTS 6,400,914 B1 * 6/2002 Noda ..... G03G 21/1867 399/111
2015/0185688 A1 * 7/2015 Koishi ..... G03G 21/1661 399/111
2016/0139558 A1 * 5/2016 Kawakami ..... G03G 21/1867 399/113

FOREIGN PATENT DOCUMENTS

JP 08-339149 A 12/1996

* cited by examiner

*Primary Examiner* — Sophia S Chen
(74) *Attorney, Agent, or Firm* — Canon USA, Inc. I.P. Division

(57) ABSTRACT

A process cartridge includes a drum unit configured to rotatably hold a photosensitive drum, a developing unit that is assembled in such a manner as to be rotatable relative to the drum unit and includes a developing roller, gap maintaining members provided to the photosensitive drum or the developing roller on both end portions of the photosensitive drum in an axial direction, and urging members configured to bias the developing unit toward the drum unit. The urging members are respectively disposed on outer sides of the gap maintaining members disposed at both end portions in the axial direction. The drum unit or the developing unit includes an electric contact portion configured to come into contact with an electric contact of an image forming apparatus when the process cartridge is attached to the image forming apparatus, the electric contact portion being disposed between the gap maintaining members in the axial direction.

6 Claims, 15 Drawing Sheets

PROCESS CARTRIDGE AND IMAGE FORMING APPARATUS

BACKGROUND OF THE INVENTION

Field of the Invention

Aspects of the present invention relate to a process cartridge and to an image forming apparatus including the same.

Description of the Related Art

The process cartridge is obtained by integrally forming a photosensitive drum and a process unit that performs a process on the photosensitive drum into a cartridge, and can be detachably attached to an image forming apparatus main body.

For example, the photosensitve drum and at least one of a development unit, a charging unit, and a cleaning unit serving as the process units may be integrally formed into a cartridge. The image forming apparatus (electrophotographic image forming apparatus) forms an image on a recording medium through electrophotography.

Examples of the image forming apparatus include an electrophotographic copying machine, an electrophotographic printer (such as a light emitting diode (LED) printer and a laser beam printer), a fax machine, a word processor, and the like.

In an image forming apparatus, a photosensitive drum is uniformly charged. The photosensitive drum is an electrophotographic photosensitive member that generally has a drum shape and serves as an image carrier. Then, the charged photosensitive drum is selectively exposed, so that an electrostatic latent image (electrostatic image) is formed on the photosensitive drum. The electrostatic latent image formed on the photosensitive drum is developed with toner as a developer to be a toner image. The toner image formed on the photosensitive drum is transferred onto a recording material such as a recording sheet or a plastic sheet. The toner image transferred on the recording material is heated and pressed, whereby the toner image is fixed on the recording material in this manner, image recording is performed.

Such an image forming apparatus usually requires toner replenishment and maintenance for various process units. A process cartridge has been commercially used so that the toner replenishment and the maintenance can be easily performed. The process cartridge is obtained by providing the photosensitive drum, the charging unit, the development unit, the cleaning unit, and the like in a frame to form a cartridge, and can be detachably attached to the image forming apparatus main body.

Such a process cartridge system enables a user to perform maintenance for the apparatus without a professional help, and thus can achieve large improvement in operability, so that an image forming apparatus with excellent usability can be provided. Thus, many image forming apparatuses employ the process cartridge system.

In one generally known configuration of the process cartridge, a photosensitive unit and a development device unit are coupled to each other with a coupling member. The photosensitive unit holds the photosensitive drum, the cleaning unit, and the like. The development device unit holds a development unit such as a developing roller.

In the process cartridge, the development device unit is held in such a manner as to be rotatable, relative to the photosensitive unit, about a rotational axis. The development device unit is biased toward the photosensitive unit by its own weight and pressing force from a pressing member such as a spring and from the outside.

The development device unit is biased toward the photosensitive drum in the photosensitive unit, with gap maintaining members in between. The gap maintaining members are attached to both end portions of the developing roller in the axial direction.

The gap maintaining members, attached to both end portions of the developing roller in the axial direction, are in contact with the photosensitive drum while receiving a certain amount of pressing force therefrom.

Thus, a minute gap that can be constantly kept to be the same is provided between the photosensitive drum and the developing roller, whereby an image with excellent image quality can be stably output (Japanese Patent Application Laid-Open No. H08-339149).

SUMMARY OF THE INVENTION

The present disclosure of the invention is an improved version of the configuration described above. More specifically, a development device unit is biased toward a photosensitive unit, with pressing force more balanced between gap maintaining members that are on both end portions of a developing roller in the axial direction and come into contact with the photosensitive drum.

A process cartridge according to one aspect of the present invention that is detachably attached to an image forming apparatus includes a drum unit configured to rotatably hold a photosensitive drum, a developing unit that is assembled in such a manner as to be rotatable relative to the drum unit, and includes a developing roller configured to supply a developer to the photosensitive drum, gap maintaining members provided to the photosensitive drum or the developing roller on both end portions of the photosensitive drum in an axial direction, the gap maintaining members holding the developing roller while being apart from the photosensitive drum with a gap in between, and urging members configured to bias the developing unit toward the drum unit in such a direction that the developing roller comes into contact with the photosensitive drum. The urging members are respectively disposed on outer sides of the gap maintaining members disposed at both end portions in the axial direction. The drum unit or the developing unit includes an electric contact portion configured to come into contact with an electric contact of the image forming apparatus when the process cartridge is attached to the image forming apparatus, the electric contact portion being disposed between the gap maintaining members in the axial direction.

An image forming apparatus according to another aspect of the present invention includes a process cartridge that is attachable and detachable, and an electric contact connected to the process cartridge. The process cartridge includes a drum unit configured to rotatably hold a photosensitive drum, a developing unit that is assembled in such a manner as to be rotatable relative to the drum unit and includes a developing roller configured to supply a developer to the photosensitive drum, gap maintaining members provided to the photosensitive drum or the developing roller on both end portions of the photosensitive drum in an axial direction, the gap maintaining members holding the developing roller while being apart from the photosensitive drum with a gap in between, and urging members respectively disposed on outer sides of the gap maintaining members disposed at both end portions in the axial direction and configured to bias the developing unit toward the drum unit in such a direction that the developing roller comes into contact with the photosensitive drum. When the process cartridge is attached to the image forming apparatus, the electric contact comes into contact with and connected to an electric contact portion disposed between the gap maintaining members in the axial direction in the process cartridge.

Further features will become apparent from the following description of exemplary embodiments with reference to the attached drawings.

DESCRIPTION OF THE EMBODIMENTS

An exemplary embodiment of the present invention is described below with reference to the drawings.

An axial direction of a rotatable photosensitive drum is defined as a longitudinal direction. A side on which the photosensitive drum receives driving force from an image forming apparatus main body in the longitudinal direction is defined as a drive side. An opposite side of the drive side is defined as a non-drive side.

Figure 2:
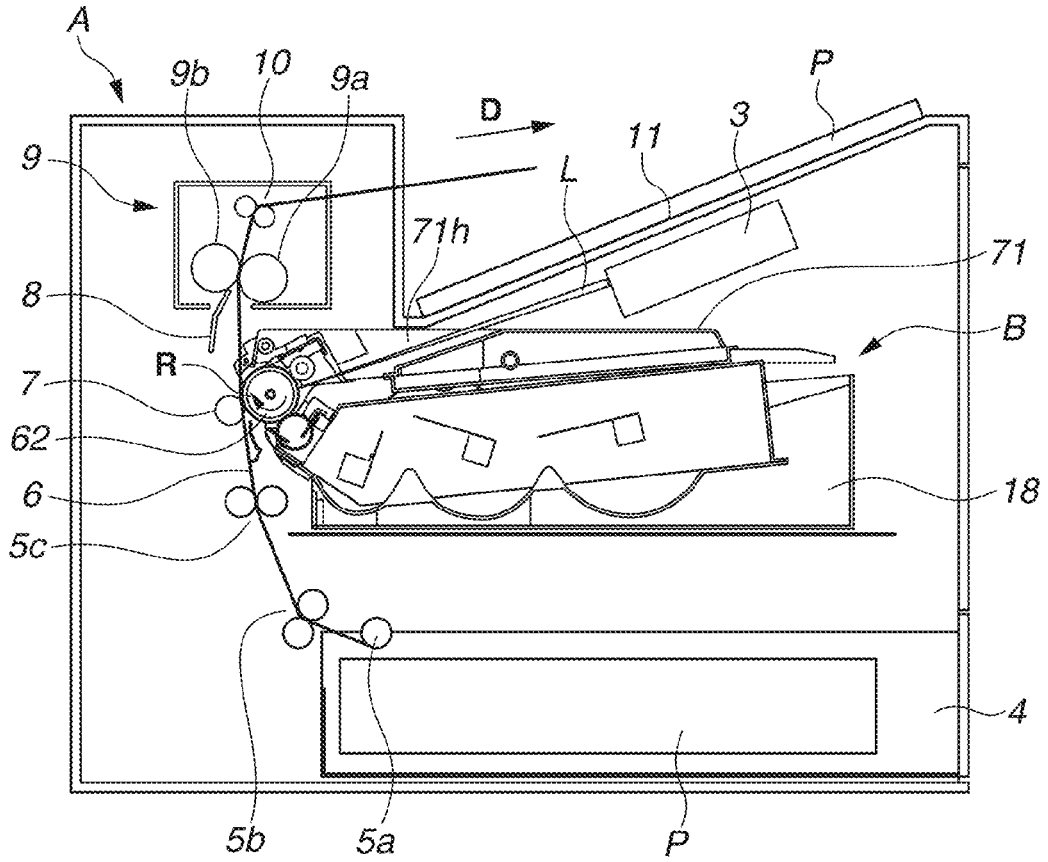
FIG. 2 is a cross-sectional view of an image forming apparatus main body and a process cartridge in an image forming apparatus according to the first exemplary embodiment.
Figure 3:
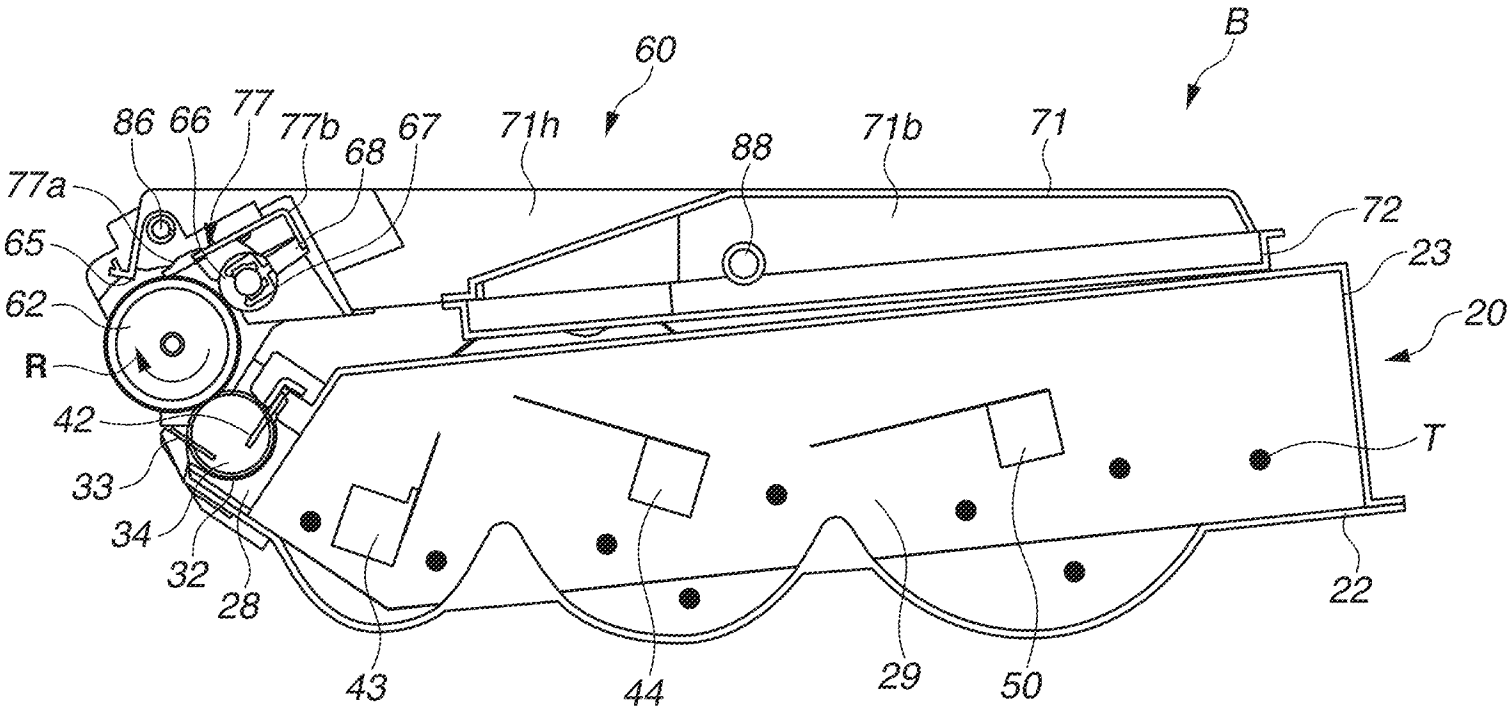
FIG. 3 is a cross-sectional view of the process cartridge according to the first exemplary embodiment.

FIG. 2 is a cross-sectional view illustrating an apparatus main body (hereinafter, referred to as an apparatus main body A) and a process cartridge (hereinafter, referred to as a cartridge B) in an image forming apparatus according to an exemplary embodiment of the present invention. FIG. 3 is a cross-sectional view of the cartridge B. The apparatus main body A is a portion of the image forming apparatus excluding the cartridge B.

<Overall Configuration of Image Forming Apparatus>

The image forming apparatus illustrated in FIG. 2 is a laser beam printer using electrophotography with the cartridge B detachably attached to the apparatus main body A. An exposure device 3 (laser scanner unit) is provided that forms a latent image on a photosensitive drum 62 of the cartridge B attached to the apparatus main body A. A sheet tray 4 is disposed below the cartridge B and accommodates a recording medium (hereinafter, referred to as a sheet member P) as a target of image forming.

In the apparatus main body A, a pickup roller 5*a*, a pair of feed rollers 5*b*, a pair of conveyance rollers 5*c*, a transfer guide 6, a transfer roller 7, a conveyance guide 8, a fixing device 9, a pair of discharge rollers 10, a discharge tray 11, and the like are arranged in this order in a conveyance direction. D of the sheet member P. The fixing device 9 includes a heating roller 9*a* and a pressing roller 9*b*.

<Overall Configuration of Cartridge>

Figure 4:
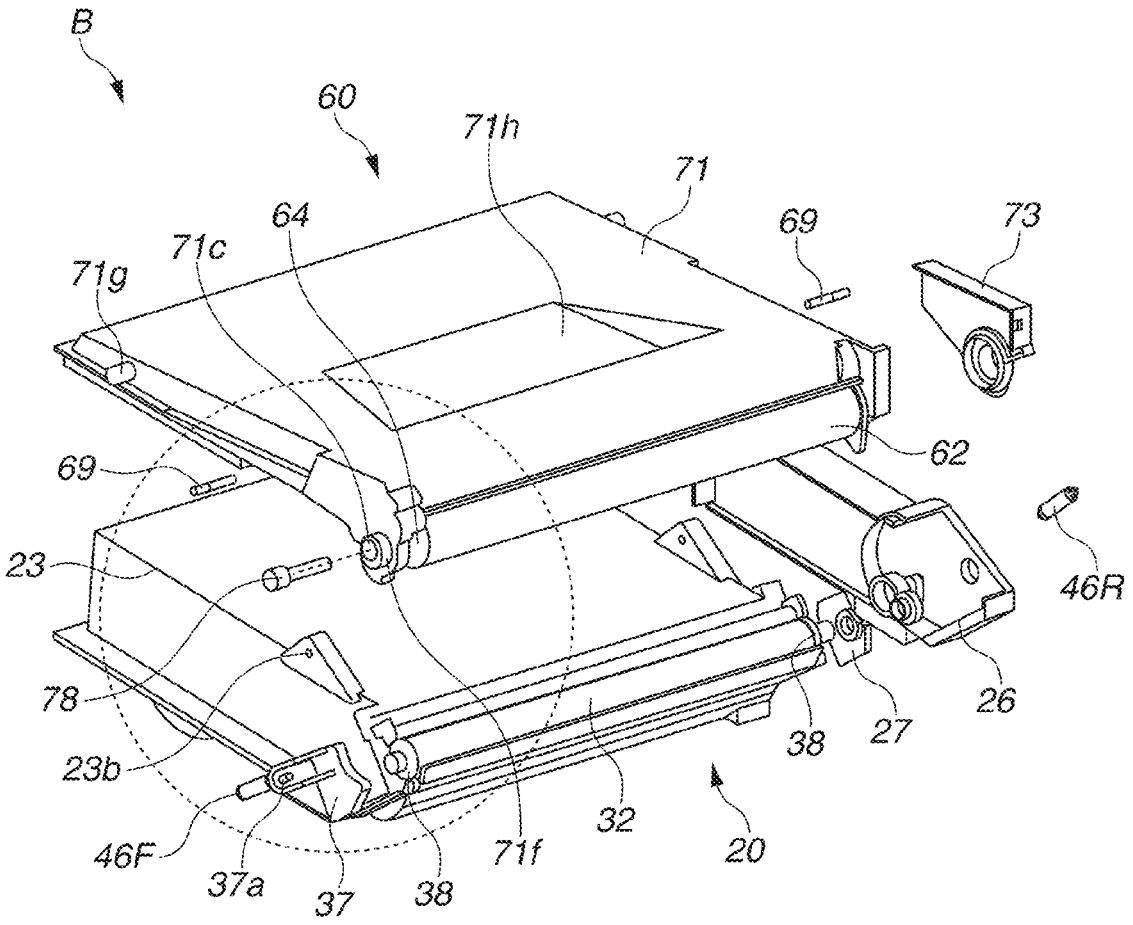
FIG. 4 is an exploded view of the process cartridge according to the first exemplary embodiment.
Figure 5:
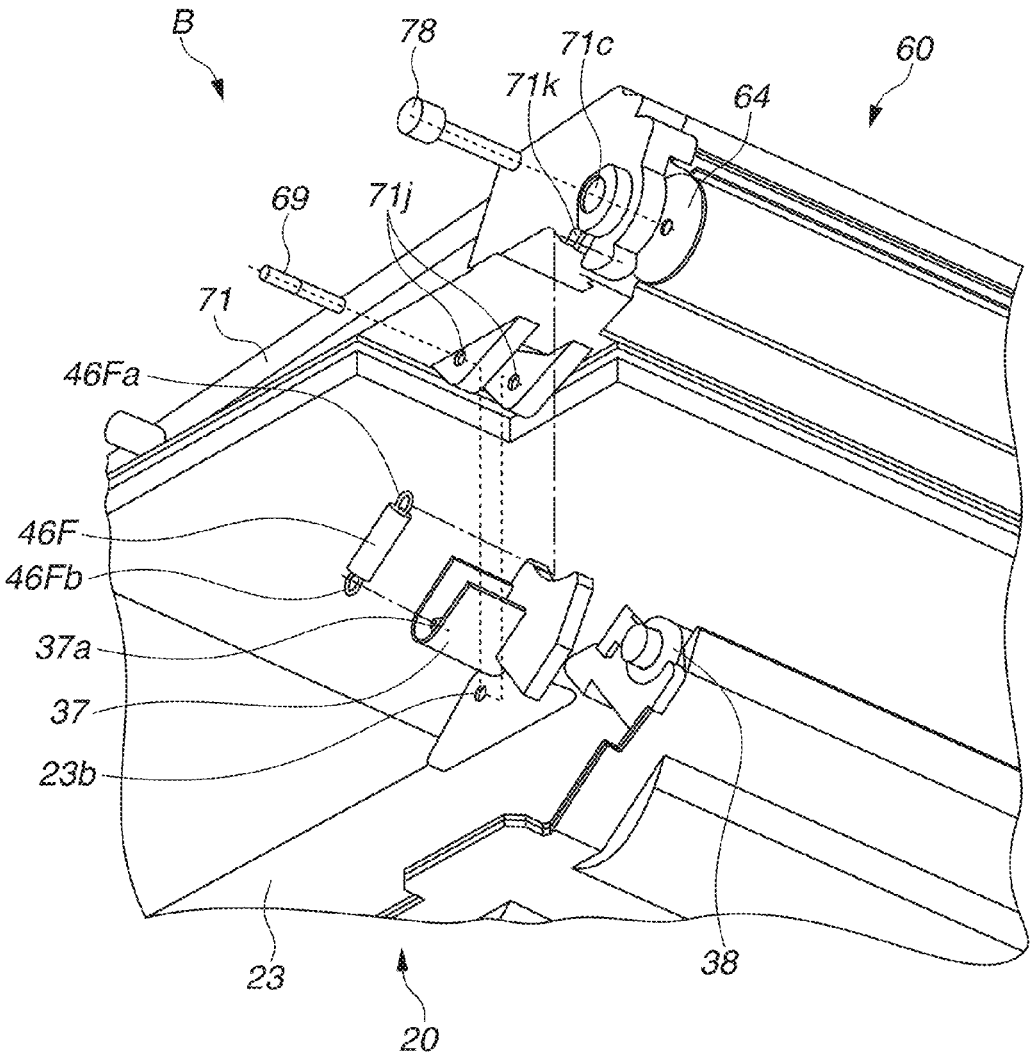
FIG. 5 is an exploded view of the process cartridge according to the first exemplary embodiment.
Figure 6:
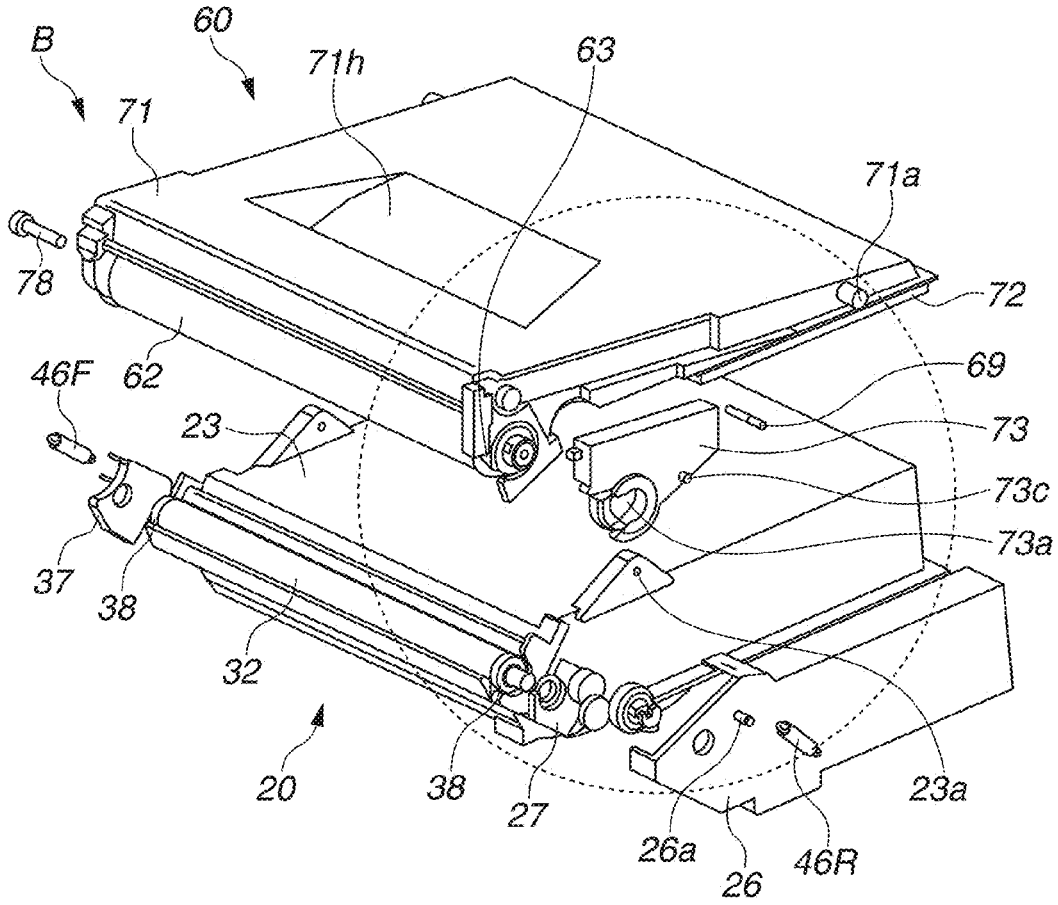
FIG. 6 is an exploded view of the process cartridge according to the first exemplary embodiment.
Figure 7:
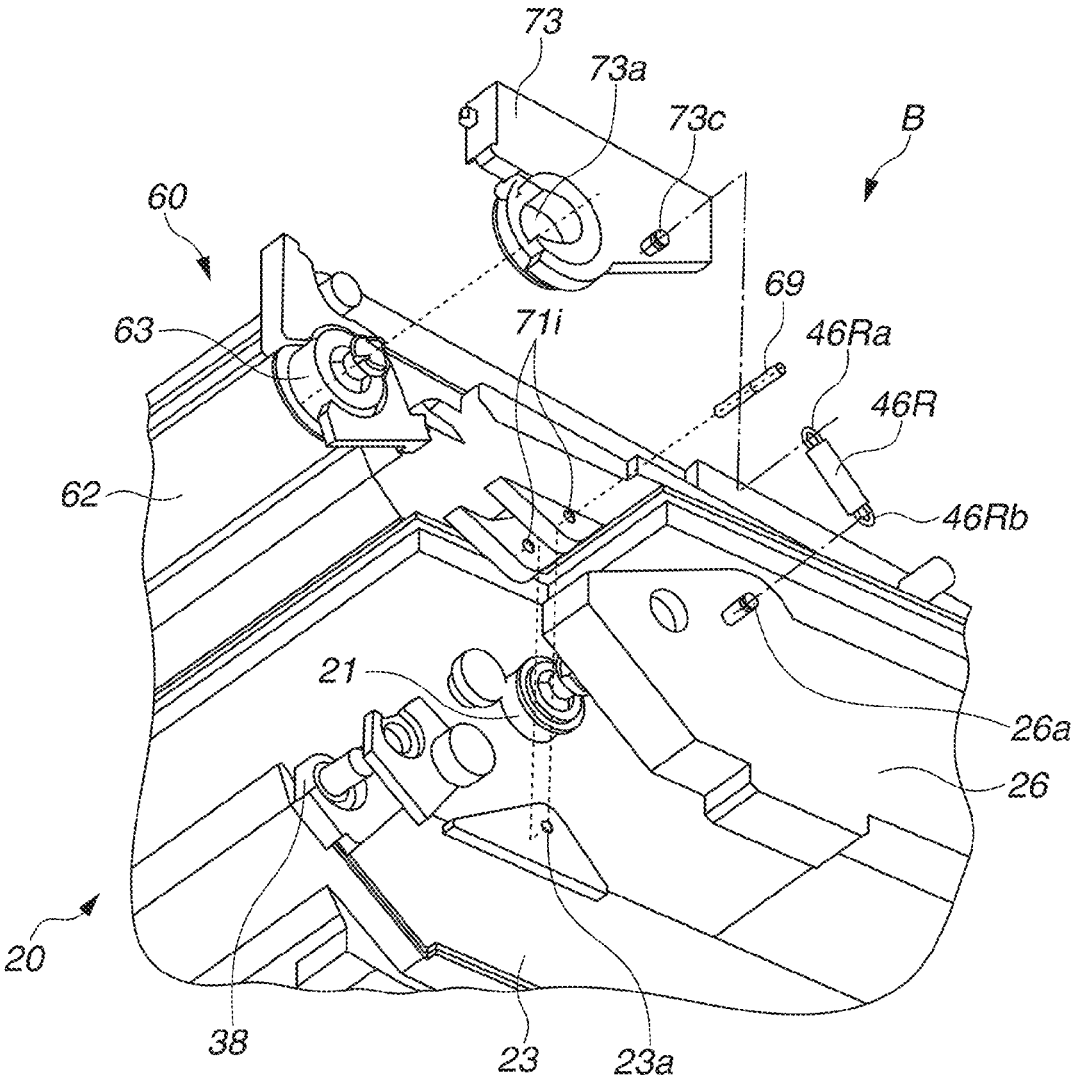
FIG. 7 is an exploded view of the process cartridge according to the first exemplary embodiment.

An overall configuration of the cartridge B is described with reference to FIGS. 3 to 8. FIG. 3 is a cross-sectional view of the cartridge B. FIGS. 4 to 8 are each a perspective view illustrating a configuration of the cartridge B. FIGS. 5 and 7 are partially enlarged views respectively illustrating dotted line portions in FIGS. 4 and 6, as viewed from different angles, with screws for coupling the components together omitted in the present exemplary embodiment.

The cartridge B includes a cleaning unit 60 and a developing unit 20. A general process cartridge is obtained by integrally forming a photosensitive drum (electrophotographic photosensitive member) and at least one of a charging unit, a development unit, and a cleaning unit serving as process units that perform processes on the photosensitive drum, to be a cartridge detachably attached to the apparatus main body. The process cartridge (cartridge B) according to the present exemplary embodiment includes the cleaning unit 60 as a drum unit including the photosensitive drum 62 and at least the developing unit 20 including the development unit.

As illustrated in FIG. 3, the cleaning unit 60 includes the photosensitive drum 62, a charging roller 66, a cleaning member 77, a cleaning frame 71 supporting these components, and a lid member 72 fixed to the cleaning frame 71 by welding or the like. In the cleaning unit 60, the charging roller 66 and the cleaning member 77 are each disposed while being in contact with an outer circumference surface of the photosensitive drum 62.

The cleaning member 77 includes a rubber blade 77*a* and a supporting member 77*b*. The rubber blade 77*a* is an elastic member that is made of rubber as an elastic material and has a blade shape. The supporting member 77*b* supports the rubber blade 77*a*. The rubber blade 77*a* extends in a counter direction relative to a rotational direction of the photosensitive drum 62 to be in contact with the photosensitive drum 62. In other words, the rubber blade 77*a* comes into contact with the photosensitive drum 62 with its distal end portion directed toward an upstream side in the rotational direction of the photosensitive drum 62.

As illustrated in FIG. 3, waste toner removed from the surface of the photosensitive drum 62 by the cleaning member 77 is collected in a waste toner chamber 71*b* formed by the cleaning frame 71 and the lid member 72. The waste toner is conveyed by a first screw 86 serving as a waste toner conveyance member, a second screw (not illustrated), and a third screw 88. The first screw 86 is disposed near the photosensitive drum 62, the second screw is disposed at an end portion of the cleaning frame 71 in the longitudinal direction, and the third screw 88 is disposed on the waste toner chamber 71*b*. Thus, the first screw 86 and the third screw 88 each have a rotation axis in parallel with the rotation axis of the photosensitive drum 62. The second screw has a rotation axis orthogonal to the rotation axis of the photosensitive drum 62. The first screw 86 rotates by receiving driving force transmitted thereto from a second coupling 21 illustrated in FIG. 7, via a gear (not illustrated). The second screw rotates by receiving driving force transmitted from the first screw 86, and the third screw 88 rotates by receiving driving force transmitted from the second screw.

As illustrated in FIG. 3, a scooping sheet 65 that prevents the waste toner from leaking from the cleaning frame 71 is disposed at an end portion of the cleaning frame 71 while being in contact with the photosensitive drum 62.

The photosensitive drum 62 is drivingly rotated in a direction indicating by an arrow R in the figure, in accordance with an image forming operation, by receiving driving force from a main body driving motor (not illustrated) serving as a driving source.

The charging roller 66 is rotatably attached to both end portions of the cleaning frame 71 in the longitudinal direction (approximately parallel with the rotation axis direction of the photosensitive drum 62) via charging roller bearings 67. The charging roller 66 is in pressure contact with the photosensitive drum 62 with the charging roller bearings 67 being pressed by urging members 60 toward the photosensitive drum 62. The charging roller 66 is driven to be rotated by the rotation of the photosensitive drum 62.

As illustrated in FIG. 3, the developing unit 20 includes a developing roller 32, a developing container 23 that supports the developing roller 32, a developing blade 42, and the like. The developing roller 32 incorporates a magnet roller 34. The developing blade 42 is disposed in the developing unit 20 to regulate the thickness of a toner layer on the developing roller 32. As illustrated in FIGS. 4 and 6, gap maintaining members 38 are attached to both end portions of the developing roller 32. The gap maintaining members 38 come into contact with the photosensitive drum 62, whereby the developing roller 32 is held while being apart from the photosensitive drum 62 with a small gap in between. As illustrated in FIG. 3, a blowout prevention sheet 33 that prevents the toner from leaking from the developing unit 20 is disposed on an edge portion of a bottom member 22 in such a manner as to come into contact with the developing roller 32. The developing container 23 and the bottom member 22 form a toner chamber 29 provided with a first conveyance member 43, a second conveyance member 44, and a third conveyance member 50. The first conveyance member 43, the second conveyance member 44, and the third conveyance member 50 convey toner T to a toner supply chamber 28 while stirring the toner T contained in the toner chamber 29.

As illustrated in FIGS. 4 and 6, the cartridge B is a combination of the cleaning unit 60 and the developing unit 20.

The cleaning unit 60 includes the cleaning frame 71, the lid member 72, and the photosensitive drum 62, as well as a drum bearing 73 and a drum shaft 78 rotatably supporting the photosensitive drum 62. As illustrated in FIG. 7, a drive side drum flange 63 is provided on the drive side of the photosensitive drum 62, and is rotatably supported by a hole portion 73*a* of the drum bearing 73. As illustrated in FIG. 5, a non-drive side drum flange 64 on a non-drive side of the photosensitive drum 62 has a hole portion rotatably supported by a drum shaft 78 press-fit in a hole portion 71*c* of the cleaning frame 71.

On the other hand, the developing unit 20 includes, as illustrated in FIGS. 3, 4, and 6, the bottom member 22, the developing container 23, a drive side development side member 26, the developing blade 42, the developing roller 32, and the like. The developing roller 32 has hearing members 27 and 37, disposed on both ends, to be rotatably attached to the developing container 23.

As illustrated in FIGS. 5 and 7, the cartridge B is formed with the cleaning unit 60 and the developing unit 20 rotatably coupled to each other via coupling pins 69.

More specifically, at both end portions of the developing unit 20 in the longitudinal direction, a development first supporting hole 23*a* and a development second supporting hole 23*b* are formed in the developing container 23. At both end portions of the cleaning unit 60 in the longitudinal direction, first suspension holes 71*i* and second suspension holes 71*j* are formed in the cleaning frame 71. The cleaning unit 60 and the developing unit 20 are rotatably coupled to each other with the coupling pins 69 press-fit in the first suspension holes 71*i* and the development first supporting hole 23*a*, and in the second suspension holes 71*j* and the development second supporting hole 23*b*.

A drive side urging member 46R has a first hole portion 46Ra hooked on a boss 73*c* of the drum bearing 73 and a second hole portion 46Rb hooked on a boss 26*a* of the drive side development side member 26.

A non-drive side urging member 46F has a first hole portion 46Fa hooked on a boss 71*k* of the cleaning frame 71 and a second hole portion 46Fb hooked on a boss 37*a* of a bearing member 37.

In the present exemplary embodiment, the drive side urging member 46R and the non-drive side urging member 46F are each formed of a tension spring. The developing unit 20 is biased toward the cleaning unit 60 by the urging force of the springs, whereby the developing roller 32 is certainly pressed toward the photosensitive drum 62. With the gap maintaining members 38 attached to both end portions of the developing roller 32, the developing roller 32 is supported while being apart from the photosensitive drum 62 by predetermined gaps.

Figure 8:
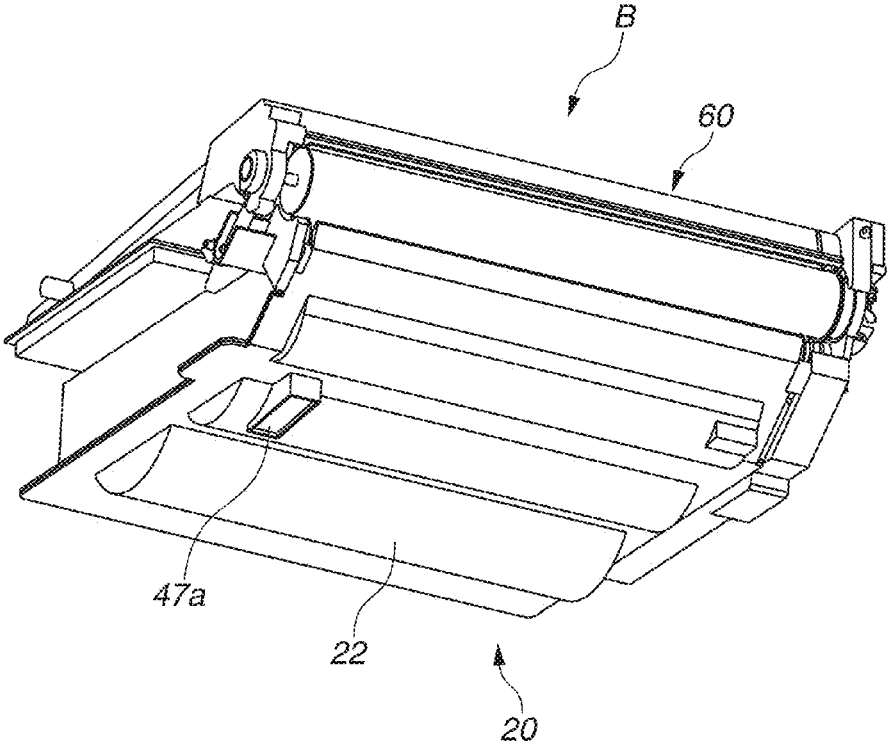
FIG. 8 is a perspective view of the process cartridge according to the first exemplary embodiment.

As illustrated in FIG. 8, the developing unit 20 has an electric contact portion 47*a* to be in contact with an electric contact 12 (illustrated in FIG. 12) of the apparatus main body A, when the cartridge B is attached to the apparatus main body A. Electricity is input and output to and from the apparatus main body A through the electric contact 12. The electric contact portion 47*a* is disposed on a lower side of the bottom member 22 of the developing unit 20. How the electric contact portion 47*a* is arranged is described in detail below.

<Image Forming Process>

An overview of an image forming process is described. The photosensitive drum 62 is drivingly rotated in the direction indicated by the arrow R at predetermined circumference speed. (process speed), based on a print start signal.

In the cartridge B, the charging roller 66 to which bias voltage is applied comes into contact with and uniformly charges the outer circumference surface of the photosensitive drum 62.

The exposure device 3 outputs a laser beam L, corresponding to image information, through a laser opening 71*h* formed in the cleaning frame 71 of the cartridge B. The outer circumference surface of the photosensitive drum 62 is scanned by the laser beam L, and thus an electrostatic latent image, corresponding to the image information, is formed on the outer circumference surface of the photosensitive drum 62.

In the developing unit 20 serving as a developing device, the toner T in the toner chamber 29 is stirred and conveyed as the first conveyance member 43, the second conveyance member 44, and the third conveyance member 50 rotate, to be sent to the toner supply chamber 28.

The toner T is carried on the surface of the developing roller 32 due to magnetic force of the magnet roller 34 (fixed magnet). The developing blade 42 frictionally charges the toner T and also regulates the thickness of the layer of the toner T on the circumference surface of the developing roller 32. With this layer of toner T, the electrostatic latent image is developed on the photosensitive drum 62 to be visualized as a toner image.

As illustrated in FIG. 2, the sheet member P accommodated in a lower portion of the apparatus main body A is sent from the sheet tray 4 by the pickup roller 5*a*, the pair of feed rollers 5*b*, and the pair of conveyance rollers 5*c* in such a manner as to match the output timing of the laser beam L. The sheet member P is conveyed to a transfer position between the photosensitive drum 62 and the transfer roller 7 through the transfer guide 6. The toner images are sequentially transferred, at the transfer position, onto the sheet member P from the photosensitive drum 62.

The sheet member P on which the toner image has been transferred is separated from the photosensitive drum 62 to be conveyed along the conveyance guide 8 to the fixing device 9. Then, the sheet member P passes through a nip portion between the heating roller 9*a* and the pressing roller 9*b* of the fixing device 9. The toner image is fixed on the sheet member P through press/heat fixing processing executed in the nip portion. The sheet member P as a result of the processing of fixing the toner image is conveyed to the pair of discharge rollers 10 to be discharged onto the discharge tray 11. This concludes the image forming process.

As illustrated in FIG. 3, remaining toner on the outer circumference surface of the photosensitive drum 62 after the transferring is removed by the cleaning blade 77, so that the photosensitive drum 62 becomes ready for the next image forming process. The toner thus removed from the photosensitive drum 62 is collected in the waste toner chamber 71*b* of the cleaning unit 60.

In the process described above, the charging roller 66, the developing roller 32, the transfer roller 7, and the cleaning blade 77 serve as the process units that perform processes on the photosensitive drum 62.

<Cartridge Attachment/Detachment>

How the cartridge B is attached to and detached from the apparatus main body A is described with reference to FIG. 9.

Figure 9A:
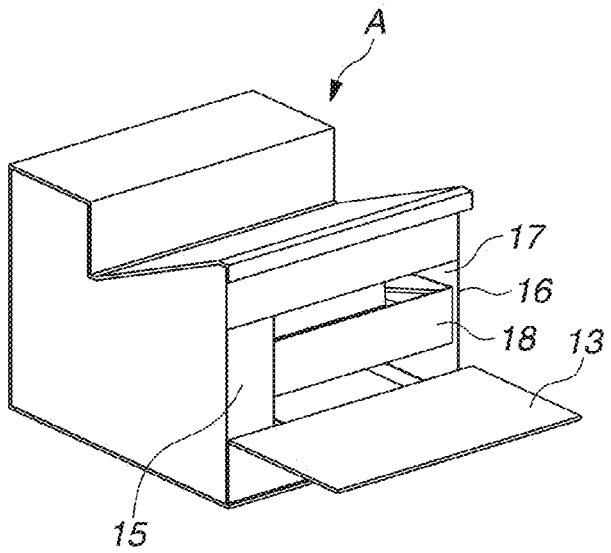
FIGS. 9A, 9B, and 9C are each a perspective view of the image forming apparatus main body, in a state where a door of the image forming apparatus according to the first exemplary embodiment is open.
Figure 9B:
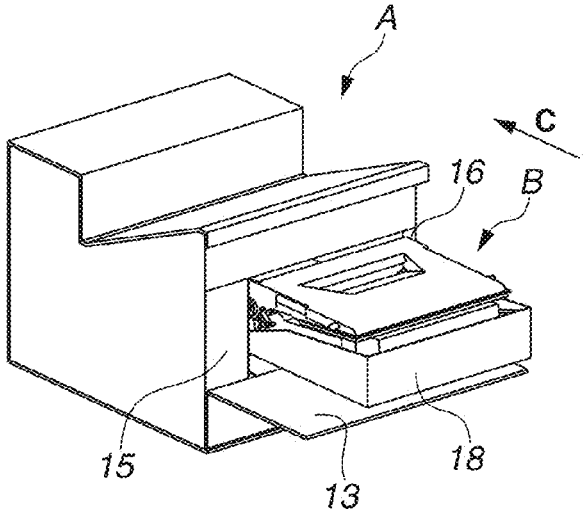
Figure 9C:
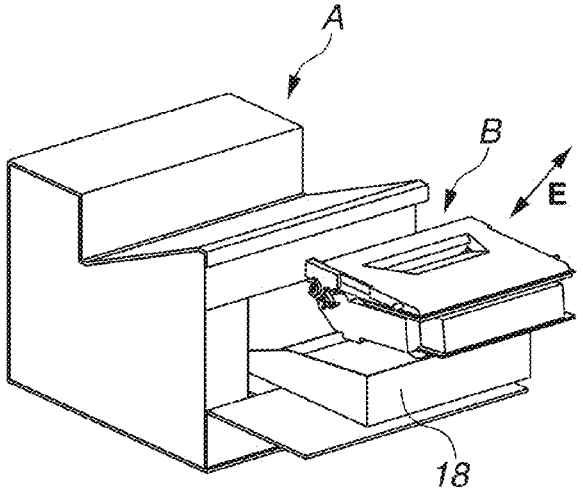

FIG. 9A is a perspective view of the apparatus main body A in a state where an opening/closing door 13 opens so that the cartridge B can be attached or detached. FIG. 9B is a perspective view of the apparatus main body A and the cartridge B in a state where the opening/closing door 13 opens so that the cartridge B can be attached or detached, and a tray 18 is pulled out. FIG. 9C is a perspective view of the apparatus main body A and the cartridge B in a state where the cartridge B is being attached/detached, with the opening/closing door 13 opened and the tray 18 pulled out. The cartridge B can be attached to and detached from the tray 18 in an attaching/detaching direction E.

The opening/closing door 13 is pivotally attached to the apparatus main body A. A cartridge insertion hole 17 is exposed when the opening/closing door 13 is open. The tray 18 with which the cartridge B is installed in the apparatus main body A is disposed in the cartridge insertion hole 17. The cartridge B can be attached to or detached from the tray 18 pulled out to a predetermined position. The cartridge B placed on the tray 18 is moved along a guiderail (not illustrated) in a direction indicated by an arrow C in the figure, to be installed in the apparatus main body A.

Thus, the photosensitive drum 62 coupled to a first coupling 70 (illustrated in FIG. 10) receives the driving force from the apparatus main body A, to be rotated. Then, the developing roller 32 receives the driving force transmitted thereto from the second coupling 21, to be rotated. The charging roller 66 and the developing roller 32 are supplied with electricity from an electricity supplying unit (not illustrated) of the apparatus main body A.

<Cartridge Supporting>

Figure 10:
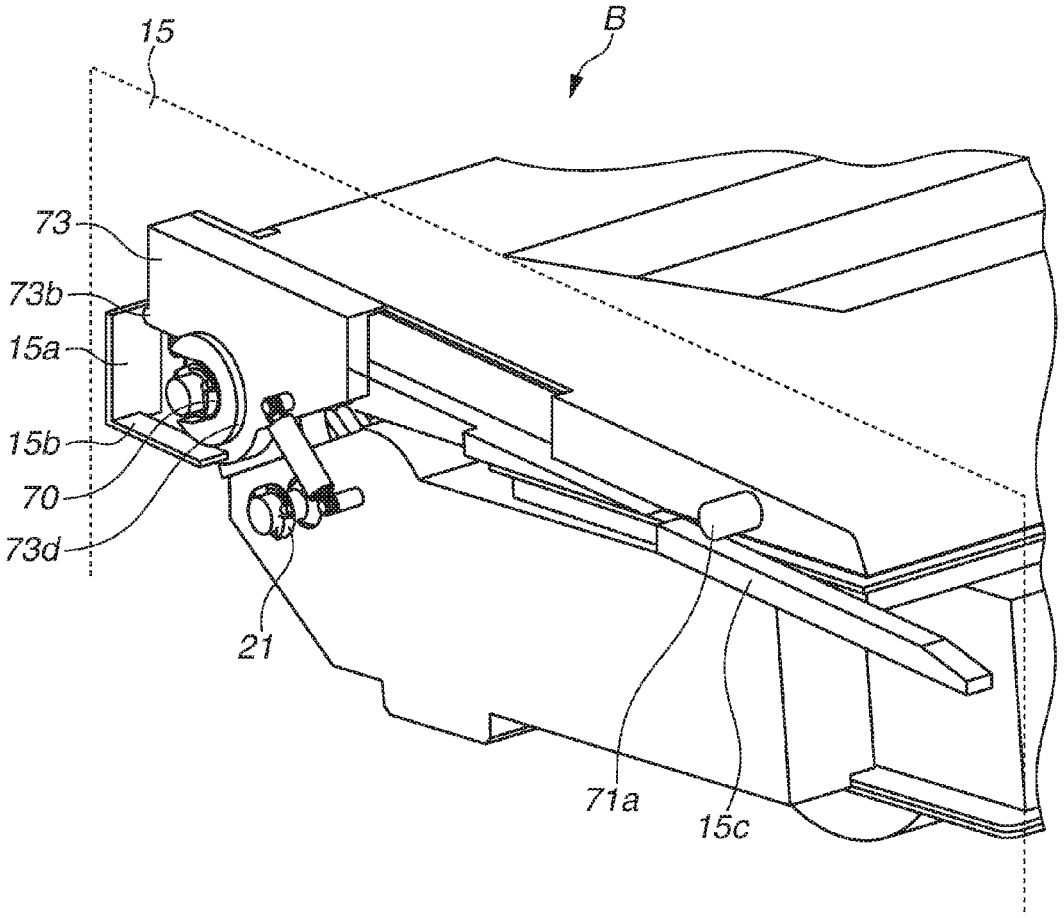
FIG. 10 is a perspective view of drive side supporting members of the process cartridge and the image forming apparatus main body, in a state where the process cartridge is attached to the image forming apparatus main body according to the first exemplary embodiment.
Figure 11:
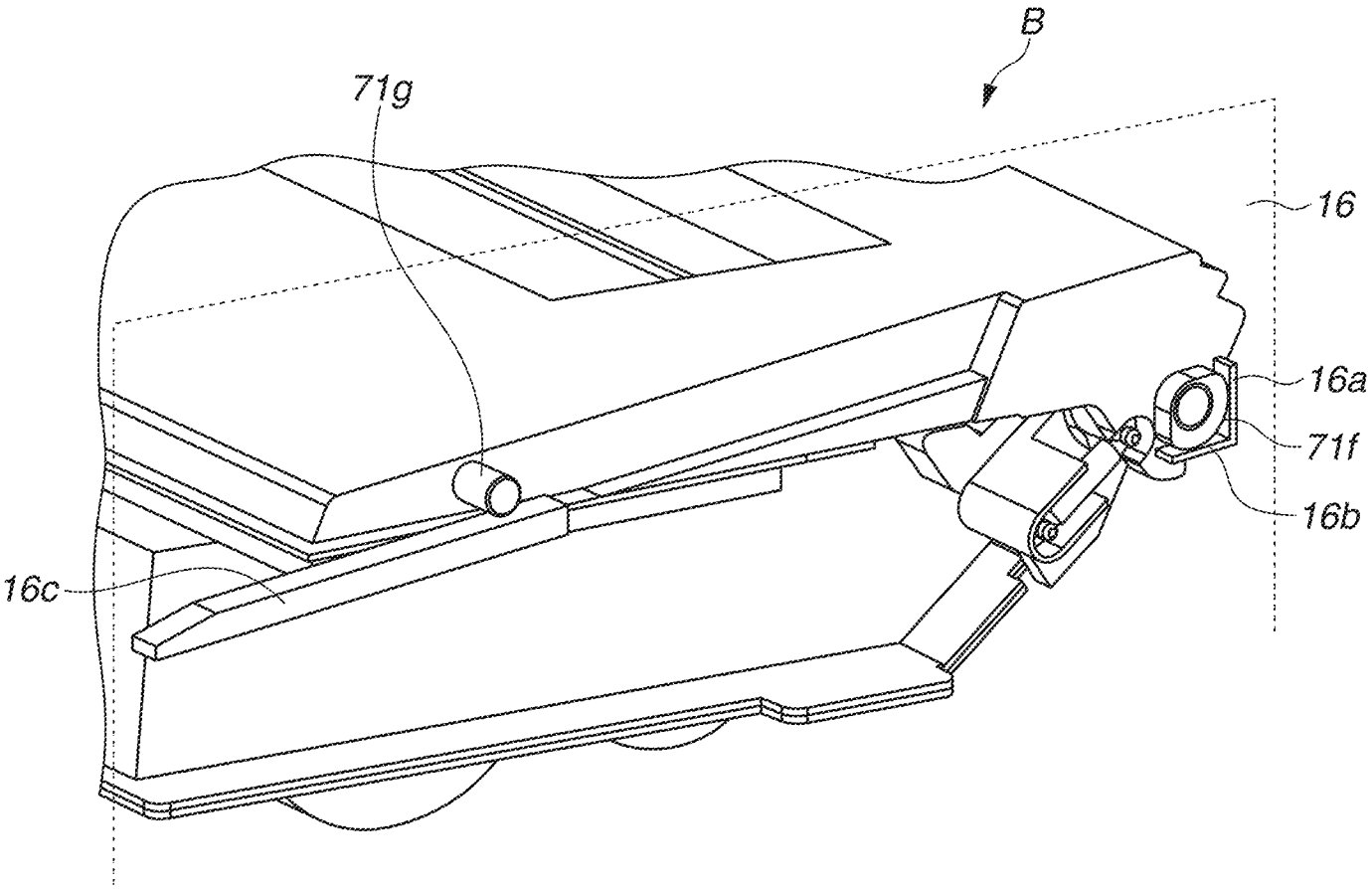
FIG. 11 is a perspective view of non-drive side supporting members of the process cartridge and the image forming apparatus main body in the state where the process cartridge is attached to the image forming apparatus main body according to the first exemplary embodiment.

As illustrated in FIG. 9A, the apparatus main body A is provided with a drive side plate 15 and a non-drive side plate 16 that support the cartridge B. As illustrated in FIGS. 10 and 11, the drive side plate 15 is provided with a drive side first supporting member 15*a*, a drive side second supporting member 15*b*, and a rotationally supporting member 15*c* for the cartridge B. The non-drive side plate 16 is provided with a non-drive side first supporting member 16*a*, a non-drive side second supporting member 16*b*, and a rotationally supporting member 16*c*.

The cartridge B has supported members including a supported member 73*b* and a supported member 73*d* of the drum bearing 73, as well as a drive side boss 71*a*, a non-drive side protrusion 71*f*, and a non-drive side boss 71*g* of the cleaning frame 71. The supported member 73*b* is supported by the drive side first supporting member 15*a*. The supported member 73*d* is supported by the drive side second supporting member 15*b*. The drive side boss 71*a* is supported by the rotationally supporting member 15*c*. The non-drive side protrusion 71*f* is supported by the non-drive side first supporting member 16*a* and the non-drive side second supporting member 16*b*. The non-drive side boss 71*g* is supported by the rotationally supporting member 16*c*. Thus, the cartridge B is positioned in the apparatus main body A.

<Positions of Electric Contact Portion and Urging Member>

Figure 1:
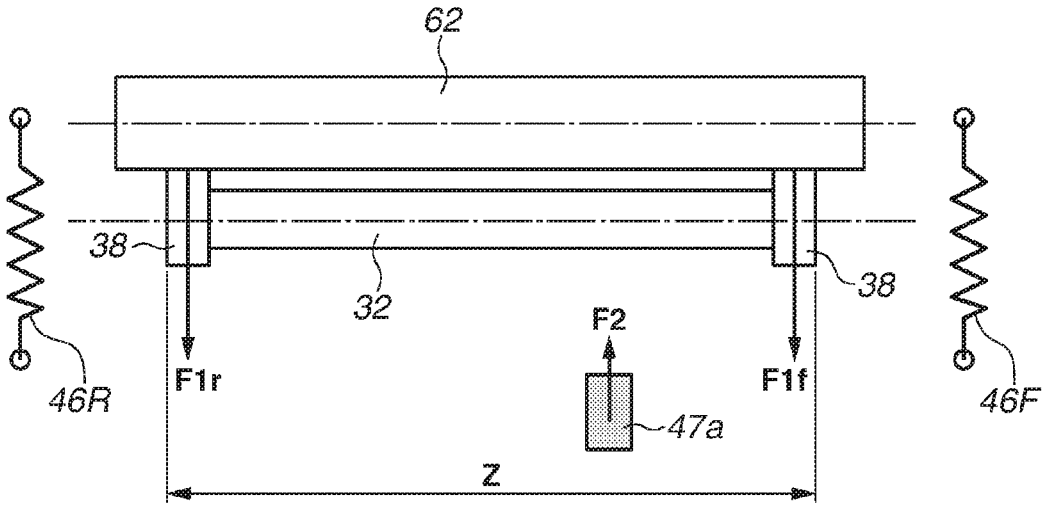
FIG. 1 is a schematic view illustrating a position of an electric contact portion according to a first exemplary embodiment.
Figure 12:
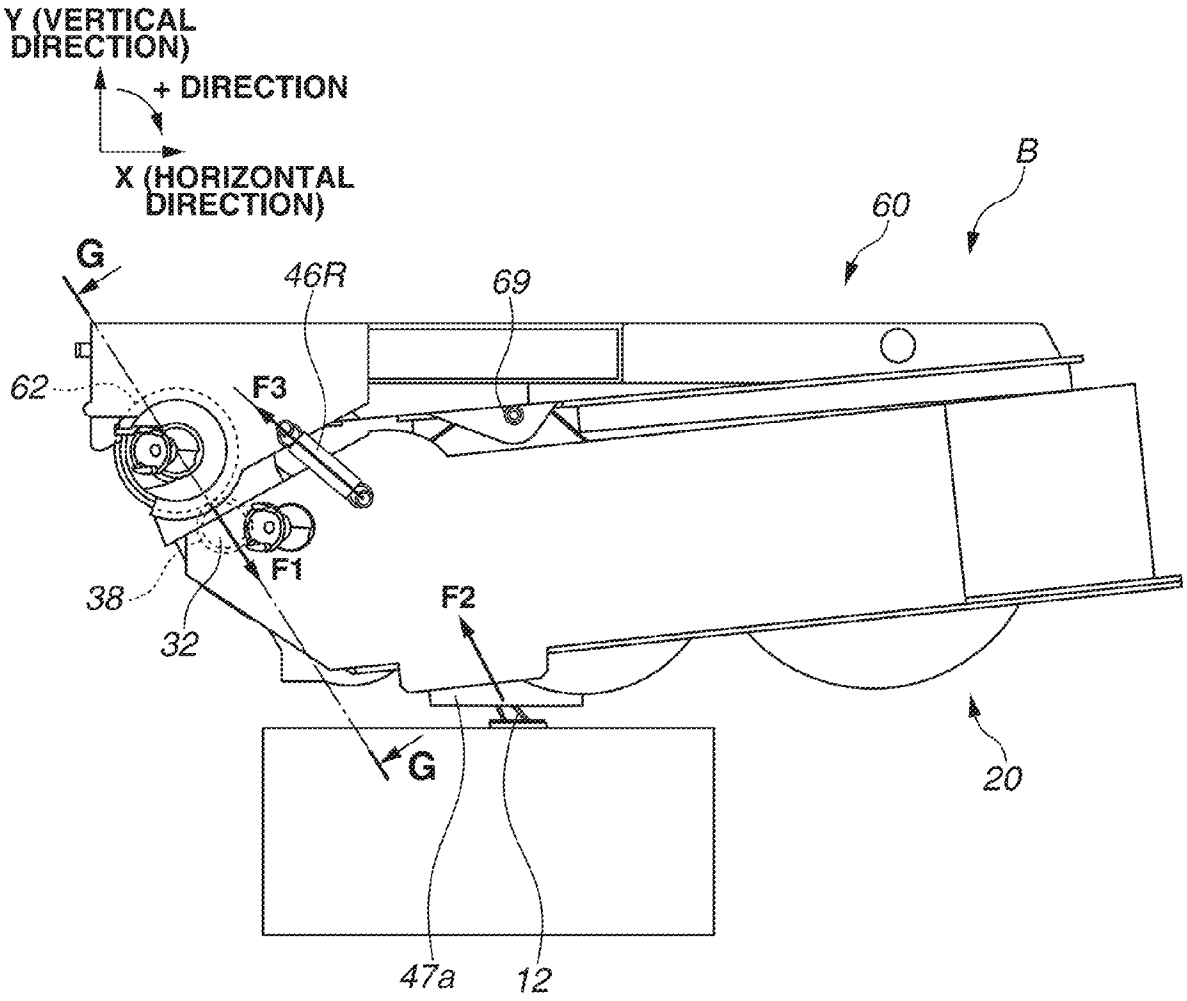
FIG. 12 is a side view of the process cartridge according to the first exemplary embodiment.

Positions of the electric contact portion 47*a* and the urging members 46R and 46F are described with reference to FIG. 1 and FIG. 12. FIG. 1 is a schematic cross-sectional view taken along a line G-G in FIG. 12, illustrating the position of the electric contact portion 47*a*. FIG. 12 is a side view illustrating the position of the electric contact portion 47*a* as viewed from one end side of the process cartridge B.

As described above, the developing roller 32 of the developing unit 20 is coupled in such a manner as to be rotatable about the coupling pins 69. The electric contact portion 47*a* provided on the developing unit 20 is in contact with the electric contact 12 of the apparatus main body A while receiving pressing force F2 therefrom when the cartridge B is attached to the apparatus main body A. The pressing force F2 is orientated in such a manner as to produce urging force of pushing the gap maintaining members 38 disposed on the end portions of the developing roller 32 in the longitudinal direction toward or away from the photosensitive drum 62. Thus, in conventional techniques, the pressing force applied to the gap maintaining members positioned at both axial direction end portions of the developing roller that comes in contact with the drum is largely unbalanced.

In view of this, the present exemplary embodiment features the urging members 46R and 46F that are disposed on both ends in the longitudinal direction, and biases the developing roller 32 of the developing unit 20 toward the photosensitive drum 62 about the coupling pins 69. More specifically, the urging members 46R and 46F are positioned on the outer sides of the gap maintaining members 38 in the longitudinal direction. Thus, a gap Z between the gap maintaining members 38 is provided in the longitudinal direction and the urging members 46B and 46F are disposed on both outer sides of the gap maintaining members 38.

In this configuration, when the contact portion between one of the gap maintaining members 38 on one side and the photosensitive drum 62 serves as a rotation center, the force of rotating the photosensitive drum 62 can be offset by the elastic force F3 of the urging member 46R or 46F on the other side. For example, when the contact portion between one of the gap maintaining members 38 on the side of the urging member 46R and the photosensitive drum 62 serves as the rotation center, the urging member 46F on the other side is farther from the rotation center, and thus the moment acting to rotate the photosensitive drum 62 can be more effectively offset by the elastic force F3 of the urging member 46F. As a result, counter force F1*r* and counter force F1*f* (e.g., as diagrammatically shown via F1, which corresponds to F1*r* and F1*f*, in FIG. 12) applied from the photosensitive drum 62 to the gap maintaining members 38 respectively on one and the other sides of the developing roller 32 in the longitudinal direction can be made small. Thus, the pressing force applied to the gap maintaining members 38 can be more balanced.

In the present exemplary embodiment, the electric contact portion 47*a* provided on the developing unit 20 is positioned between the gap maintaining members 38 in the longitudinal direction. More specifically, the electric contact portion 47*a* is disposed at a position within the gap Z between the gap maintaining members 38 in the longitudinal direction.

In this configuration, the pressing force F2 received by the electric contact portion 47*a* from the electric contact 12 of the apparatus main body A is distributed in a balanced manner to the counter force F1*r* and the counter force F1*f* so that not one of the counter force F1*r* and the counter force F1*f* but both are increased/decreased. Thus, the moment can be prevented from acting on the photosensitive drum 62 about the contact portion between one of the gap maintaining members 38 and the photosensitive drum 62, due to the pressing force F2 acting on the gap maintaining members 38. In this manner, the developing unit 20 can be biased toward the photosensitive unit 60, with the pressing force more balanced between the gap maintaining members 38 at both axial end portions of the developing roller 32 that comes into contact with the photosensitive drum 62.

As described above, in the present exemplary embodiment, the electric contact portion 47*a* is disposed between the gap maintaining members 38 in the longitudinal direction, and the moment about the contact portion involving one of the gap maintaining members 38 can be prevented from acting on the photosensitive drum 62. The urging members 46R and 46F are disposed on the outer sides of the gap maintaining members 38 on both ends in the longitudinal direction, that is, at positions sandwiching the gap maintaining members 38, and thus can more effectively offset the moment acting on the photosensitive drum 62.

The scope of the invention is not intended to be limited to the functions, the materials, the shapes, and the relative positions of the components described in the present exemplary embodiment, unless specifically noted otherwise.

A modification of the first exemplary embodiment is described with reference to some drawings. In this modification, a difference from the first exemplary embodiment is described in detail. The material, the shape, and the like are the same as those described in the first exemplary embodiment unless specifically noted otherwise. The common portions are denoted with the same reference numerals and will not be described in detail.

<Positions of Plurality of Electric Contact Portions>

Figure 13:
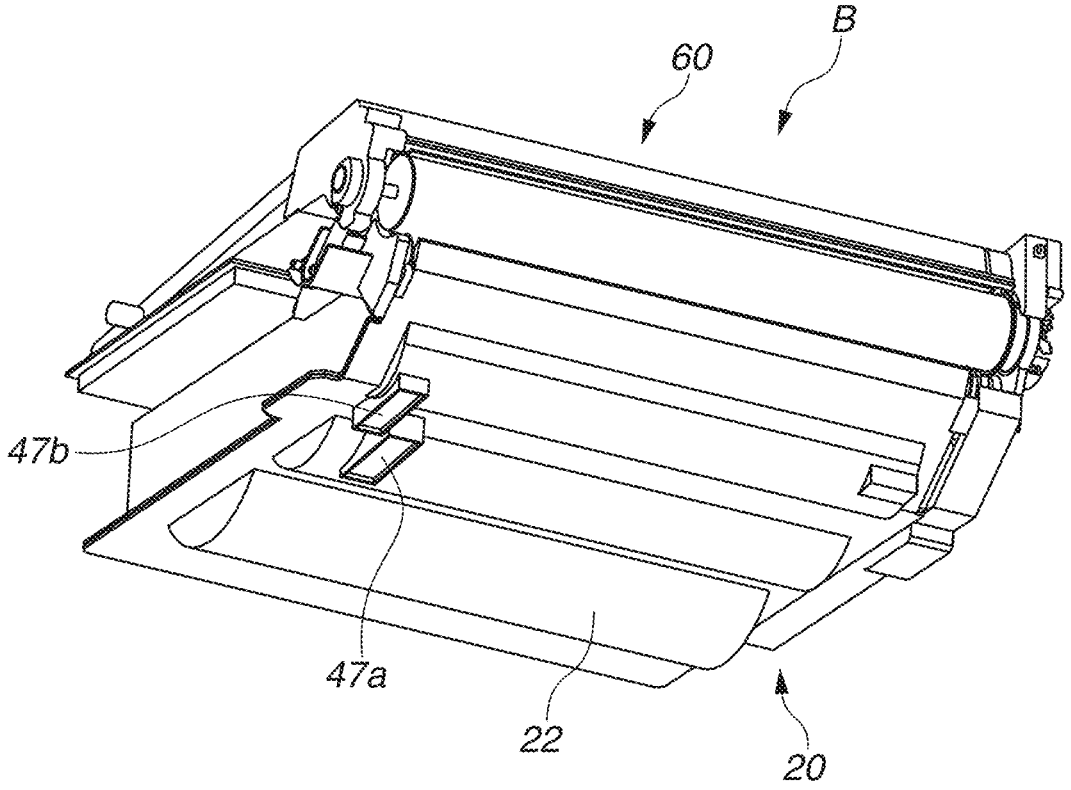
FIG. 13 is a perspective view of a process cartridge according to a modification of the first exemplary embodiment.
Figure 14:
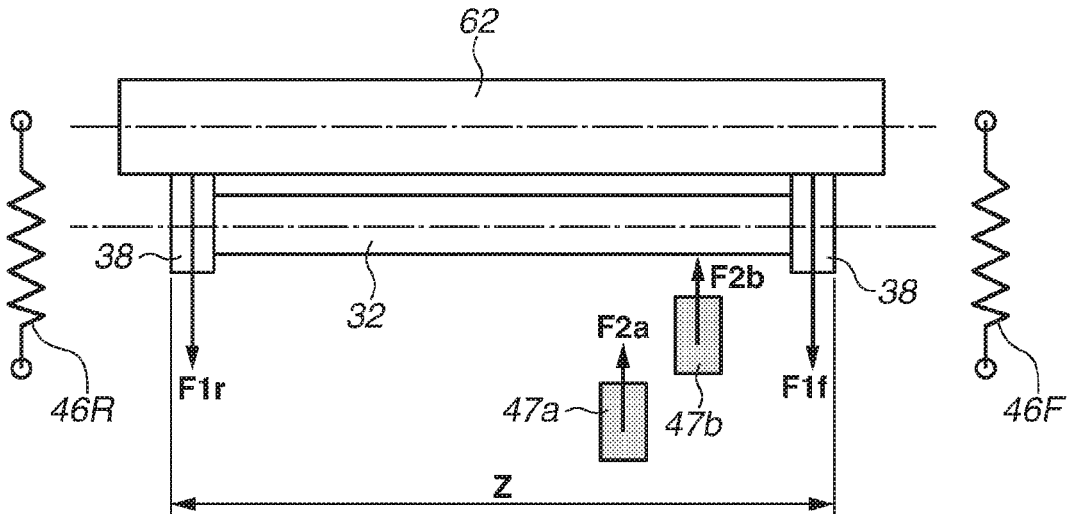
FIG. 14 is a schematic view illustrating positions of electric contact portions according to the modification of the first exemplary embodiment.
Figure 15:
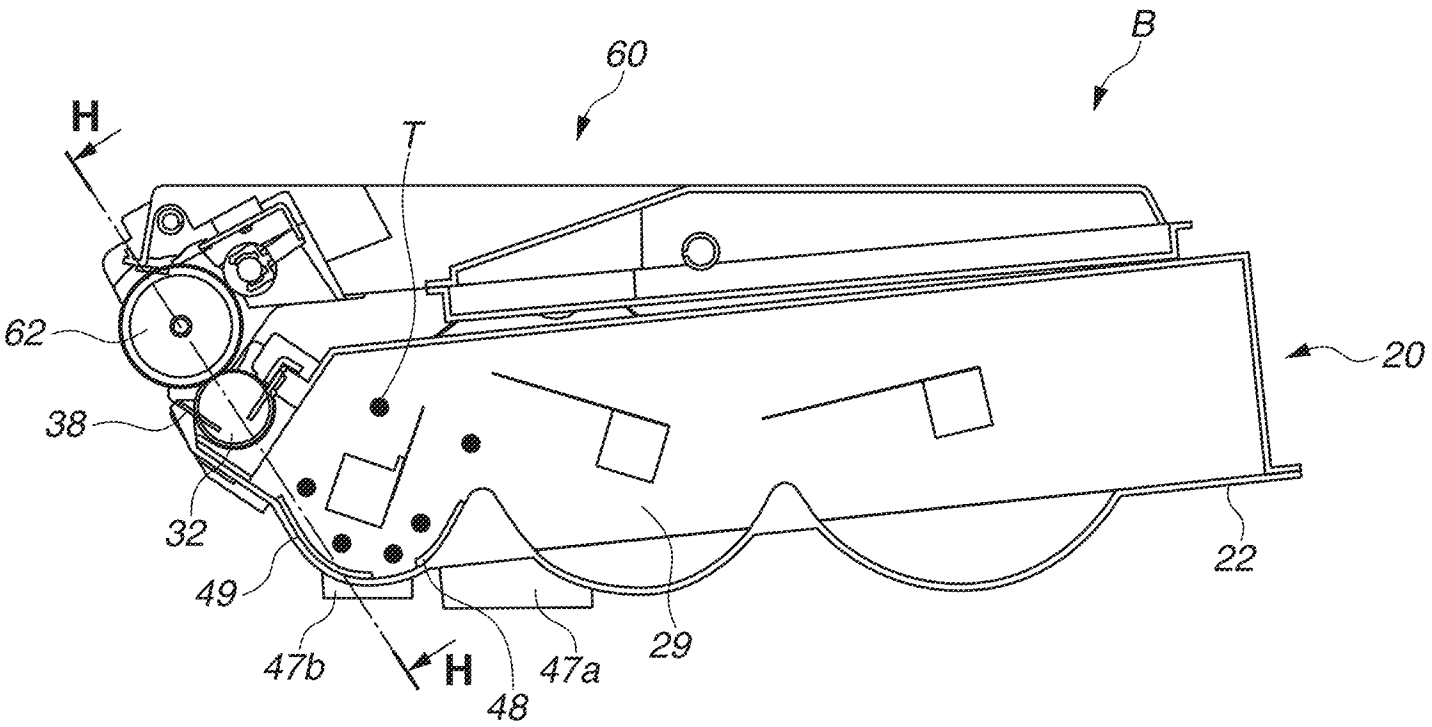
FIG. 15 is a cross-sectional view of the process cartridge according to the modification of the first exemplary embodiment.

In the present modification, a configuration where a plurality of electric contact portions is arranged is described with reference to FIGS. 13 to 15. FIG. 13 is a perspective view illustrating a configuration of the cartridge B. FIG. 14 is a cross-sectional schematic view taken along a line H-H in FIG. 15 illustrating the positions of the electric contact portions. FIG. 15 is a cross-sectional view of the cartridge B.

As illustrated in FIG. 13, a plurality of electric contact portions 47*a* and 47*b* is provided on the developing unit 20. The electric contact portions 47*a* and 47*b* come into contact with the electric contact 12 of the apparatus main body A through which electricity is input and output to and from the apparatus main body A when the cartridge B is attached to the apparatus main body A. More specifically, in the present modification, the electric contact portions 47*a* and 47*b* are disposed on a lower portion of the bottom member 22 as a part of the developing unit 20 and a part of the toner chamber 29.

When there is a plurality of electric contacts as illustrated in FIG. 15, the electric contact portions 47*a* and 47*b* are respectively connected to electrodes 48 and 49 disposed in the toner chamber 29. More specifically, the one electric contact portion 47*a* serves as an input contact to which bias is applied, and the other electric contact portion 47*b* serves as an output contact used for measuring an electrostatic capacity. Thus, in the present modification, the remaining amount of toner in the toner chamber 29 can be detected by detecting the electrostatic capacity of toner between the electrodes 48 and 49.

In the modification illustrated in FIG. 14, the electric contact portions 47*a* and 47*b* provided on the developing unit 20 are positioned between the gap maintaining members 38 in the longitudinal direction, as in the first exemplary embodiment. Thus, the electric contact portions 47*a* and 47*b* are positioned within the gap Z between the gap maintaining members 38 in the longitudinal direction.

In this configuration, pressing force F2*a* and pressing force F2*b* respectively received by the electric contact portions 47*a* and 47*b* from the electric contact 12 of the apparatus main body A are distributed in a balanced manner so that not one of the counter force F1*r* and the counter force F1*f* but both are increased/decreased. Thus, the moment about the contact portion between the photosensitive drum 62 and one of the gap maintaining members 38 can be prevented from acting on the photosensitive drum 62, due to the pressing force F2*a* and the pressing force F2*b* acting on the gap maintaining members 38. In this manner, the developing unit 20 can be biased toward the photosensitive unit 60, with the pressing force more balanced between the gap maintaining members 38 on both axial end portions of the developing roller 32 that comes into contact with the photosensitive drum 62.

In the modification described above, the plurality of electric contact portions 47*a* and 47*b* is disposed between the gap maintaining members 38 in the longitudinal direction. Thus, the moment about the contact portion involving one of the gap maintaining members 38 can be prevented from acting on the photosensitive drum 62. The urging members 46R and 46F are disposed on the outer sides of the gap maintaining members 38 on both ends in the longitudinal direction, that is, at the positions sandwiching the gap maintaining members 38. Thus, the moment acting on the photosensitive drum 62 can be more effectively offset.

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-203147, filed Oct. 14, 2015, which is hereby incorporated by reference herein in its entirety.

What is claimed is:

1. A process cartridge detachably attached to an image forming apparatus, the process cartridge comprising:

a drum unit configured to rotatably hold a photosensitive drum;

a developing unit that is assembled in such a manner as to be rotatable relative to the drum unit and includes a developing roller configured to supply a developer to the photosensitive drum;

gap maintaining members provided to the photosensitive drum or the developing roller on both end portions of the photosensitive drum in an axial direction, the gap maintaining members holding the developing roller while being apart from the photosensitive drum with a gap in between; and urging members configured to bias the developing unit toward the drum unit in such a direction that the developing roller comes into contact with the photosensitive drum, wherein the urging members are respectively disposed on outer sides of the gap maintaining members disposed at both end portions in the axial direction, and wherein the drum unit or the developing unit includes an electric contact portion configured to come into contact with an electric contact of the image forming apparatus when the process cartridge is attached to the image forming apparatus, the electric contact portion being disposed between the gap maintaining members in the axial direction.

2. The process cartridge according to claim 1, wherein a plurality of the electric contact portions is provided.

3. The process cartridge according to claim 1, wherein the electric contact portion is provided to the developing unit and is used for detecting a remaining amount of the developer in the developing unit.

4. An image forming apparatus including a process cartridge that is attachable and detachable, and an electric contact connected to the process cartridge, the process cartridge comprising:

a drum unit configured to rotatably hold a photosensitive drum;

a developing unit that is assembled in such a manner as to be rotatable relative to the drum unit and includes a developing roller configured to supply a developer to the photosensitive drum;

gap maintaining members provided to the photosensitive drum or the developing roller on both end portions of the photosensitive drum in an axial direction, the gap maintaining members holding the developing roller while being apart from the photosensitive drum with a gap in between; and urging members respectively disposed on outer sides of the gap maintaining members disposed at both end portions in the axial direction and configured to has the developing unit toward the drum unit in such a direction that the developing roller comes into contact with the photosensitive drum, wherein when the process cartridge is attached to the image forming apparatus, the electric contact comes into contact with and connected to an electric contact portion disposed between the gap maintaining members in the axial direction in the process cartridge.

5. The image forming apparatus according to claim 4, wherein a plurality of the electric contact points is provided.

6. The image forming apparatus according to claim 4, wherein the electric contact is connected to an electric contact portion that is provided on the developing unit and is used for detecting a remaining amount of the developer in the developing unit.

* * * * *